US008616804B2

(12) United States Patent
Corser

(10) Patent No.: US 8,616,804 B2
(45) Date of Patent: Dec. 31, 2013

(54) MODULAR ROADWAY

(76) Inventor: Craig Corser, Peers (CA)

( * ) Notice: Subject to any disclaimer, the term of this patent is extended or adjusted under 35 U.S.C. 154(b) by 0 days.

(21) Appl. No.: 13/595,691

(22) Filed: Aug. 27, 2012

(65) Prior Publication Data

US 2013/0051911 A1 Feb. 28, 2013

Related U.S. Application Data

(63) Continuation-in-part of application No. 13/083,831, filed on Apr. 11, 2011, now abandoned.

(30) Foreign Application Priority Data

Apr. 13, 2010 (CA) ..... 2699910

(51) Int. Cl.
*E01C 9/08* (2006.01)

(52) U.S. Cl.
USPC ..... 404/46; 404/34; 404/35; 404/36; 404/44; 52/177

(58) Field of Classification Search
CPC ..... E01C 9/086
USPC ..... 404/41, 46, 34–36, 44; 52/177
See application file for complete search history.

(56) References Cited

U.S. PATENT DOCUMENTS

| | | | | | |
|---|---|---|---|---|---|
| 1,966 | A * | 2/1841 | Carey | 404/46 |
| 3,538,819 | A * | 11/1970 | Petransky et al. | 404/35 |
| 4,277,201 | A * | 7/1981 | Abell | 404/35 |
| 4,376,596 | A * | 3/1983 | Green | 404/35 |
| 4,488,833 | A * | 12/1984 | Perry et al. | 404/35 |
| 4,875,800 | A * | 10/1989 | Hicks | 404/35 |
| 4,964,751 | A * | 10/1990 | Rope et al. | 404/35 |
| 5,275,502 | A * | 1/1994 | Glaza et al. | 404/35 |
| 5,671,496 | A * | 9/1997 | Smith | 14/69.5 |
| 6,089,784 | A * | 7/2000 | Ardern | 404/41 |
| 6,227,759 | B1 * | 5/2001 | Fricke et al. | 404/28 |
| 6,474,029 | B1 * | 11/2002 | Cook et al. | 52/223.7 |
| 6,652,183 | B2 * | 11/2003 | Stasiewich et al. | 404/35 |
| 7,934,885 | B2 * | 5/2011 | Fournier | 404/35 |
| 8,061,929 | B2 * | 11/2011 | Dagesse | 404/36 |
| 8,066,447 | B2 * | 11/2011 | Brandstrom | 404/46 |
| 8,382,393 | B1 * | 2/2013 | Phillips | 404/35 |
| 2004/0141809 | A1 * | 7/2004 | Wagstaff | 404/35 |

* cited by examiner

*Primary Examiner* — Raymond W Addie
(74) *Attorney, Agent, or Firm* — Marsh Fischmann & Breyfogle LLP

(57) ABSTRACT

A roadway is formed by a plurality of mats flexibly connected together at their ends. The mats are rectangular in configuration to form straight sections of the roadway and trapezoidal in configuration to form curved sections. Each mat comprises a flat platform of transverse wooden boards secured to side rails at their ends. The mats may be tied together at their ends by overlapping flat steel plates secured together by bolts to form links or connections. Or hinge-type assemblies may be useful. The connections have sufficient flexibility to allow the mats to conform to uneven terrain. The rails may function as curbs to limit a vehicle, passing along the roadway, from slipping off sideways. The mats are relatively light, allowing manual installation.

5 Claims, 9 Drawing Sheets

MODULAR ROADWAY

RELATED APPLICATIONS

This application is a continuation-in-part of U.S. patent application Ser. No. 13/083,831, filed Apr. 11, 2011, entitled "MODULAR ROADWAY," the entirety of which is hereby incorporated by reference.

FIELD OF THE INVENTION

This application relates to mats which can be assembled end-to-end to form a roadway over uneven ground for use by light vehicles, such as quads, all terrain vehicles and golf carts, and pedestrians.

BACKGROUND

It has long been known to provide corduroy roadways for use in constructing temporary roadway sections over marshy uneven ground, to thereby provide access for light vehicles, such as quads, to sites such as an oil drilling site, by laying logs in side-by-side array over the marshy ground. However this is time-consuming and expensive to do and requires the availability of properly sized lumber.

It is also known in the oil industry to provide large access mats that involve welded-together, rectangular frames formed from steel I-beams. The openings between the I-beams are filled in with squared logs. The mats are connected together with slot and key interlocks, to form roadways capable of supporting heavy vehicles. However these mats normally need to be laid on a graded surface. They are installed using heavy construction machines. And they are expensive to construct and install.

There remains a need for mats which can be used to form a manually constructed roadway which can be laid on uneven, non-graded, rough ground which may have short muskeg or bog sections and low spots. The present invention addresses this need.

SUMMARY

Applicant has developed a mat with certain criteria in mind, namely:

- a modular system of mats is provided whereby the mats can be flexibly linked together, end-to-end, to form a roadway;
- the links need to be sufficiently sturdy to hold the mats together even though a vehicle, such as a quad, is passing thereover and the loaded mats may be bridging across a low spot, such as a narrow creek;
- the links, while sturdy, need to be flexible enough to allow limited pivoting or hinging between adjacent mat ends to thereby enable the roadway to follow the contours of uneven ground;
- the mats need to be adapted to provide a roadway which can follow a curved path and/or a straight path;
- each mat should be light enough to be manually carried by two men to permit connection or assembly in the field;
- the mats should be compact enough so that, when coupled with the flexible links, the assembly can conform to the uneven ground surface in a manner similar to that of a heavy chain;
- the mats need to be capable of supporting a quad for travel thereover;

- the mats need to be adapted to prevent or at least resist having a vehicle, such as a quad, from slipping off sideways; and
- it is preferable that the mats be formed of biodegradable material, such as wooden boards.

The present invention provides a modular system of mats having the following characteristics:

- the dimensions and weight of each mat are limited so that the mats can be manually carried and installed by a crew of two men. Preferably each mat has a length in the order of about 8 feet, a width in the order of about 6 or 7 feet and weighs in the order of about 180-200 pounds. The mats are therefore compact enough to follow the main contours of uneven ground, can be transported to the area of use using light machines, can be installed by a crew of two and, due to the mass of a series of linked units, function to anchor one or more mats bridging a low spot;
- in use the mats are flexibly linked together end-to-end by links operative to flex or hinge to a limited extent. The links enable adjacent mat ends to pivot relative to each other to allow the mats to follow ground contours. The links interconnect the mat ends and hold them together so that they can bridge over short low spots; and
- the mats incorporate curbs extending upwardly along their side edges. The curbs function to strengthen the overall assembly and also provide anchoring structure to which to attach the links.

Broadly stated, a roadway for use by light vehicles is provided, comprising: a plurality of wooden mats flexibly linked together end-to-end so that adjacent mat ends can pivot relative to each other to allow the mats to follow the contours of underlying uneven ground, the mats having rails extending upwardly along their side edges to provide curbs, each mat being sufficiently light so that it can be manually carried by two men for assembly in the field, the links being mounted to the ends of the rails, and the mats having protrusions extending downwardly from their undersides for anchoring them to the ground.

DESCRIPTION

Figure 5:
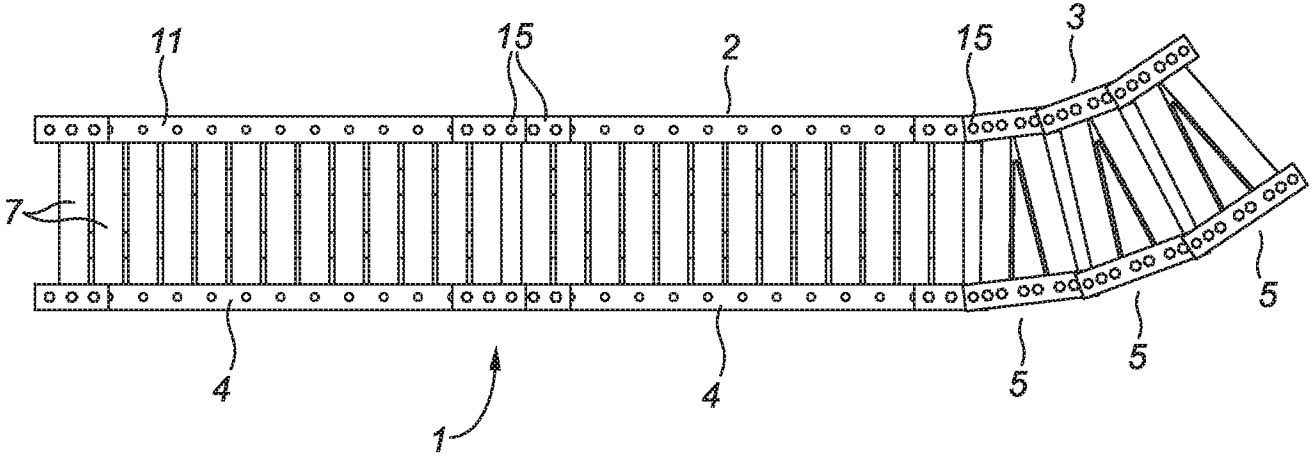
FIG. 5 is a top plan view of a roadway comprising straight and curved sections.
Figure 6:
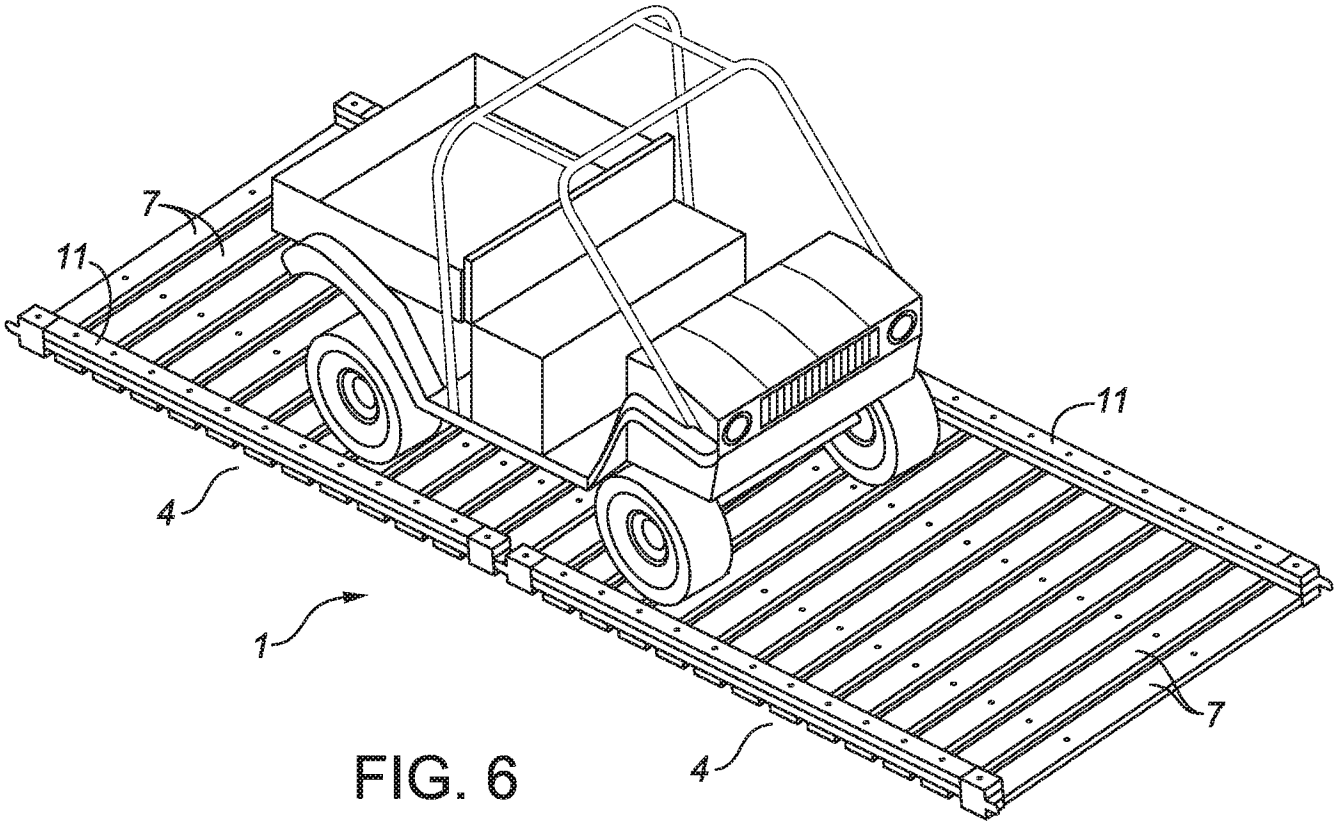
FIG. 6 is a perspective view showing a section of roadway with a quad positioned thereon.

In general, and with initial reference to FIG. 5, a roadway 1 in accordance with the invention comprises straight and curved sections 2, 3 of rectangular and trapezoidal mats 4, 5, flexibly linked together in end-to-end alignment.

As the component for constructing straight sections of the roadway, a rectangular mat is provided including:

- a flat platform of transverse rectangular boards aligned in side by side formation;
- rails secured to the platform to form a coherent unit therewith and extending upwardly therefrom along the side edges thereof, for providing curbs to resist sideways sliding of a quad passing over the platform;
- optionally, downwardly projecting, spaced apart straps extending longitudinally of the underside of the platform and secured to the platform, for reinforcing and supporting the platform and cooperating with the rails and boards to form a coherent structure; and
- links, for example flat steel plates or hinges, bolted on the ends of the rails, for flexibly linking one mat end to another in end to end alignment;
- the mat preferably being light enough to be manually conveyed by two men.

For constructing curved sections of the roadway, a mat is provided having a trapezoidal platform, formed of trapezoidally shaped boards and having side edges of unequal length.

When a roadway is formed in one embodiment, it includes at least one linear section of rectangular mats flexibly linked together in end-to-end alignment, each such mat including a flat platform formed of rectangular boards, arranged side by side and secured to rails extending upwardly therefrom along the side edge portions of the platform, for providing curbs; and at least one curved section of trapezoidal mats flexibly linked together in end to end formation and to the linear section, each trapezoidal mat having a flat platform formed of trapezoidally shaped boards and side rails, the platform having side edges of unequal length.

Preferably, the mats are wooden and are light enough to be individually carried by two men.

Preferably the means for linking mats may be apertured flat steel plates bolted to and projecting beyond the ends of the rails, the plate of one mat rail being bolted to a plate of an adjacent mat rail, or hinging brackets and bolts.

Figure 1:
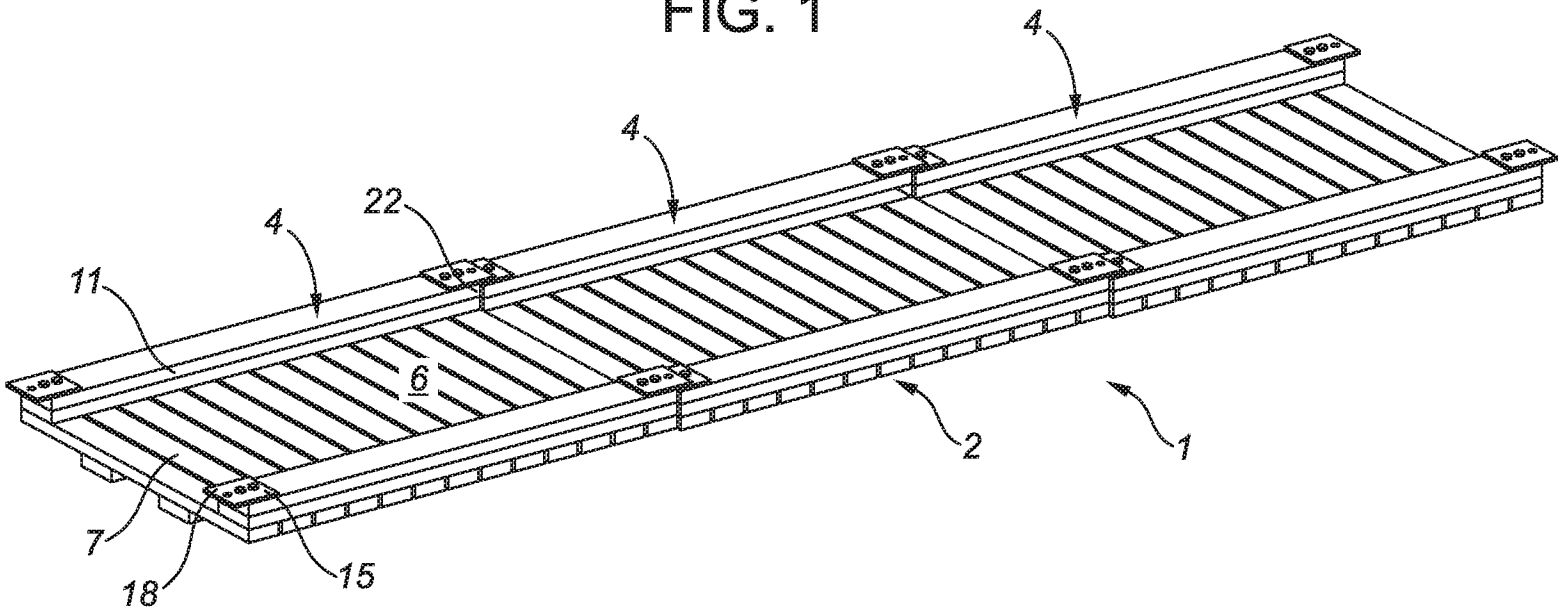
FIG. 1 is a perspective view of a straight section of a temporary roadway formed of mats linked together in end-to-end alignment for extending over uneven ground.
Figure 2A:
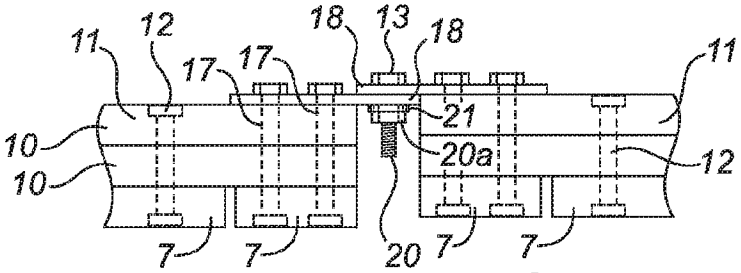
FIG. 2A is a side view of a disengagable flexible connection or link securing together the ends of two mats.
Figure 2:
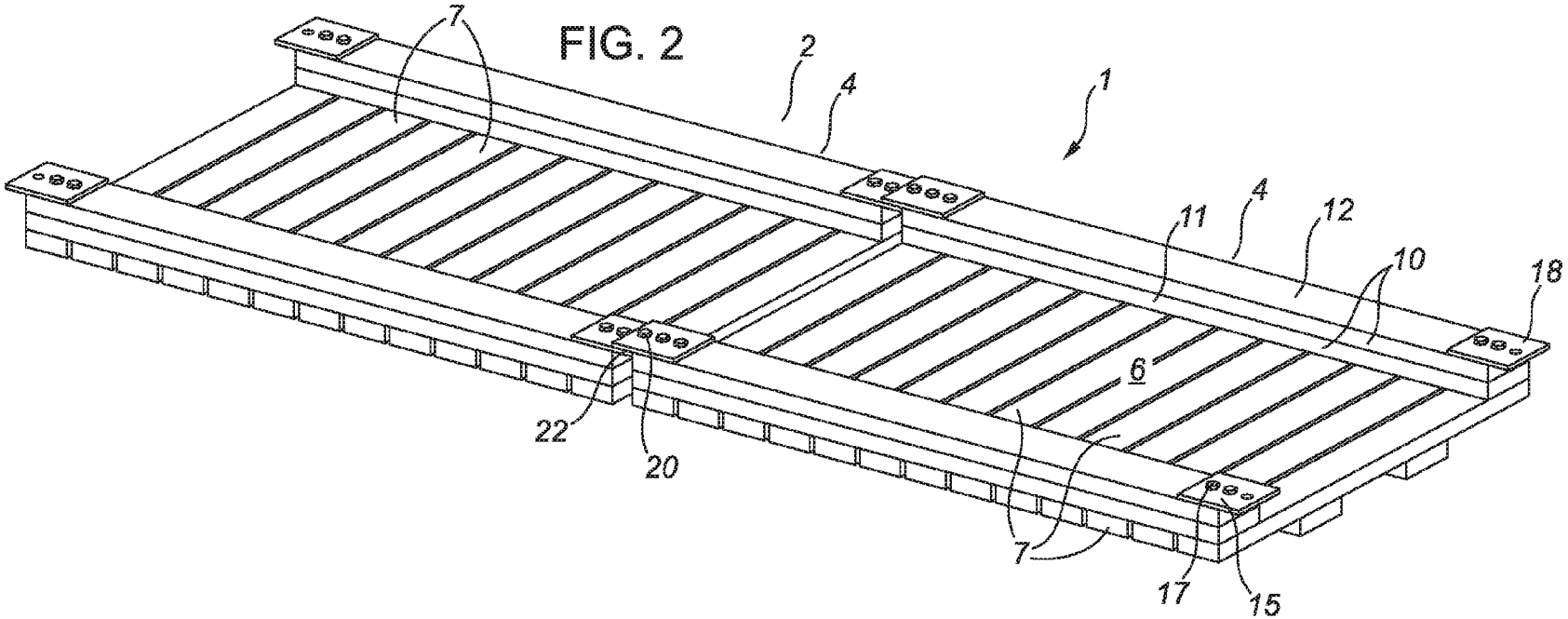
FIG. 2 is a closer-up view of part of the roadway of FIG. 1 showing detail of one form of links.
Figure 3:
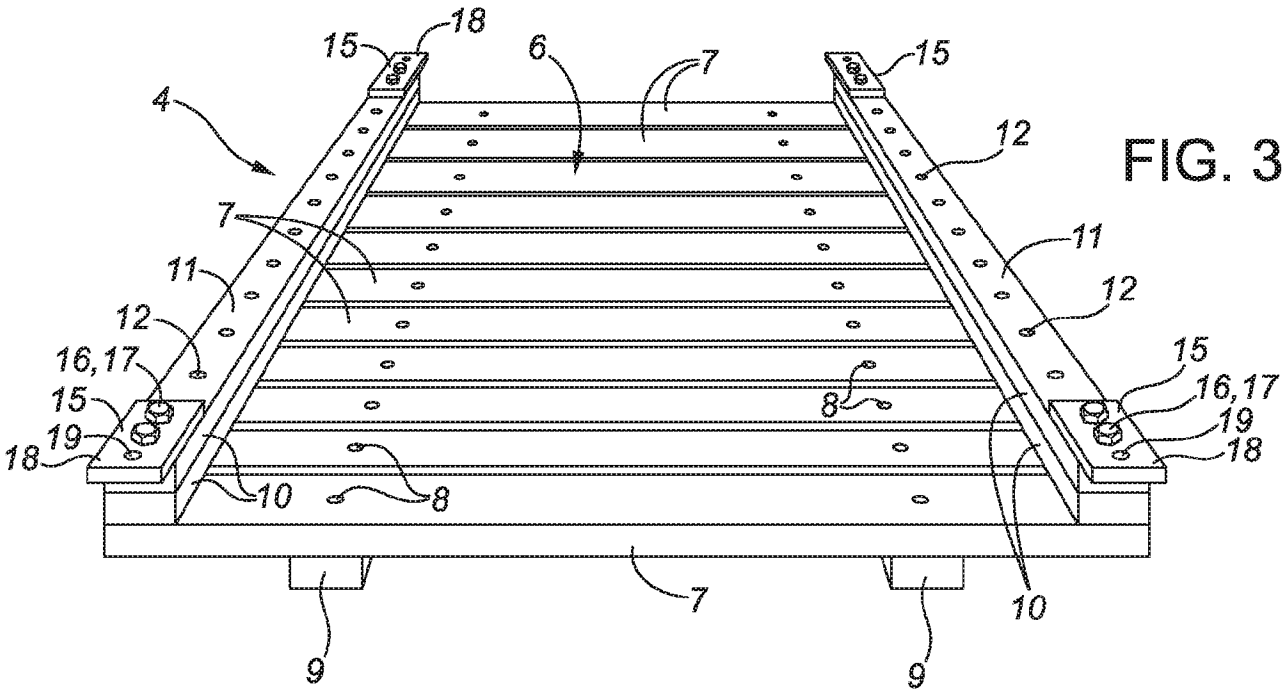
FIG. 3 is a perspective end view of a rectangular mat.
Figure 14:
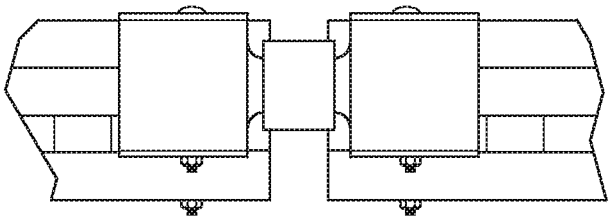
FIG. 14 is a side view of a hinging link with a retainer clip attached.

In one embodiment, and with additional reference to FIGS. 1-3, each rectangular mat 4 may include a rectangular wooden platform 6. For instance, the platform may be 8' in length, 6 or 7' in width and formed of ¾"×6"×6' lodgepole pine boards 7 laid in transverse, parallel, spaced apart, side-by-side formation. The boards 7 may be secured by steel bolts 8 (see FIGS. 3 and 3A) to a pair of spaced apart, underlying 2"×4" longitudinally extending straps 9, for reinforcement. The bolts may protrude downwardly (as shown in FIG. 14) to anchor the mat to the ground. A pair of 2"×4"×8' boards 10 are stacked along each side edge of the platform 6 to form a side rail 11. Each side rail 11 may be secured to the platform 6 by bolts 12 (see FIGS. 3 and 3A, not shown not in other figures). Each side rail 11 may extend the length of the platform 6 and may provide a curb for resisting sideways slippage off the roadway 1 by a light vehicle, such as a quad, passing along the roadway 1.

Flat steel plates 15, forming bolt holes 16, may be secured by bolts 17 to the ends of the side rails 11. Each plate 15 may project beyond an end of the side rail 11 to which it is secured. The projecting portion 18 of each plate 15 forms a bolt hole 19. As shown in FIG. 2A, the projecting portions 18 of adjacent plates 15 overlap when the plates 15 are brought together. A nut and bolt assembly 20, which may include a nut 20*a*, a bolt 13 and a plastic washer 21, ties the adjacent plates 15 together to form a connection 22. The connections 22 function to flexibly link adjacent mats 4, 5 together in end-to-end alignment.

Figure 3A:
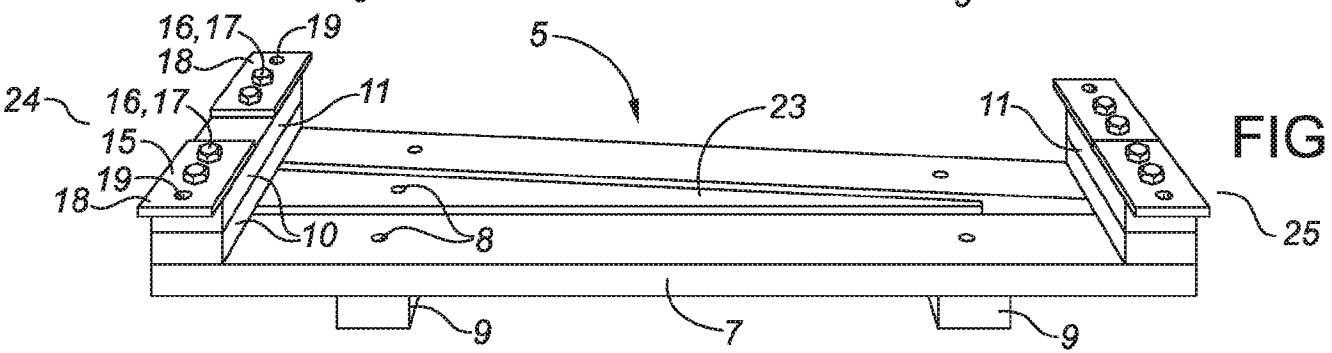
FIG. 3A is an end view of a trapezoidal mat for use in a curved section of roadway.
Figure 4:
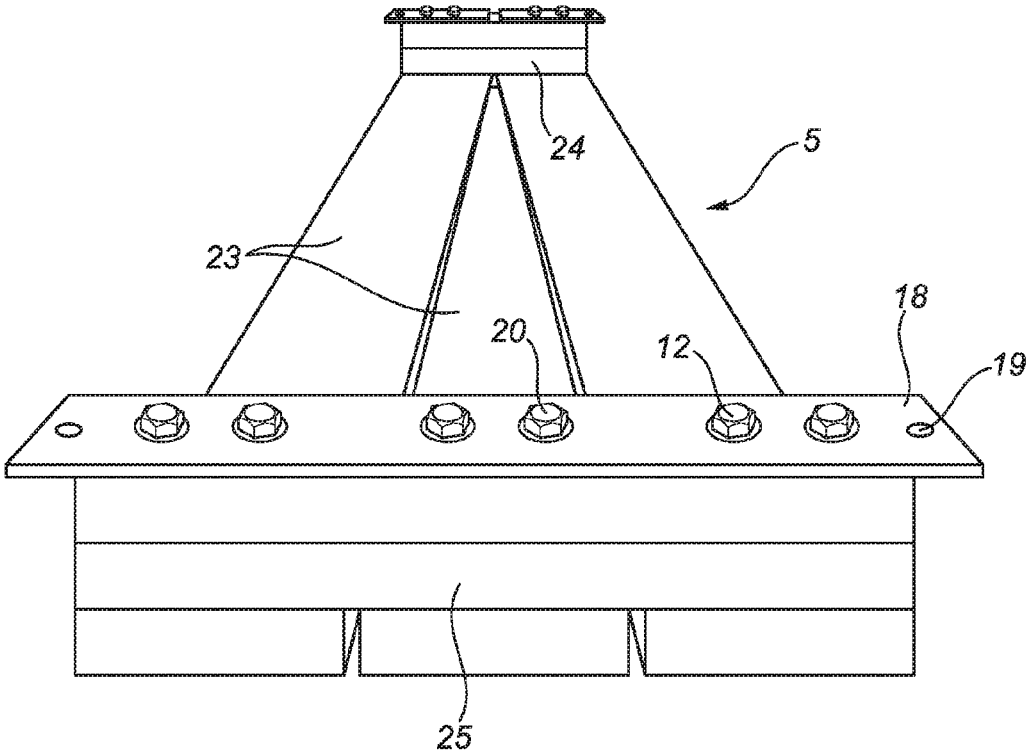
FIG. 4 is a perspective side view of the trapezoidal mat of FIG. 3A.

As shown in FIGS. 4 and 3A, trapezoidal mats 5 may be provided to form the curved sections 3 of the roadway 1. Each trapezoidal mat 5 may conform in construction with the rectangular mat 4 except that: the platform 6 may be formed of trapezoidically shaped boards 23; the trapezoidal mats 5 may be shorter in length than the rectangular mats 4 and may incorporate fewer platform boards than the rectangular mats 4; and the sides 24, 25 of each trapezoidal mat 6 may be unequal in length.

Figure 8:
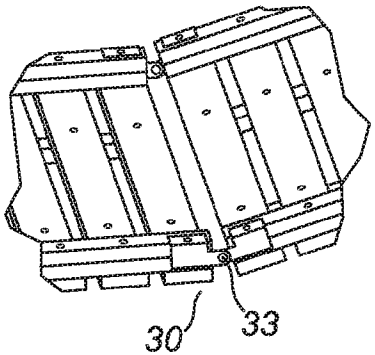
FIG. 8 is a perspective view of a pair of adjacent mat ends, connected by hinging links in a pivoted condition.
Figure 7:
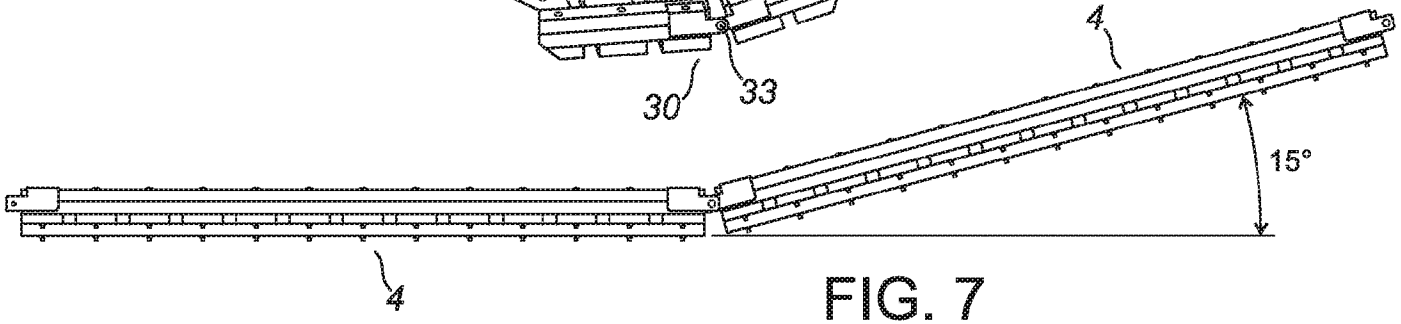
FIG. 7 is a side view showing a pair of flexibly linked mats with one mat pivoted relative to the other.
Figure 9:
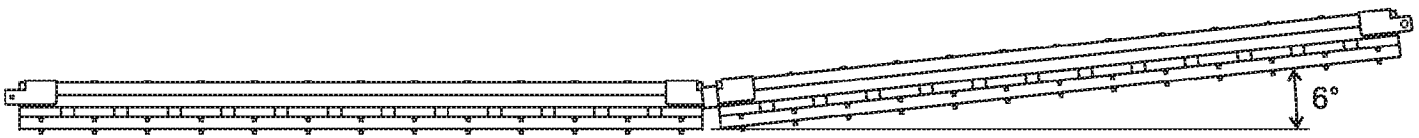
FIG. 9 is a side view similar to FIG. 7, with a retainer clip in place on the pivoted link.
Figure 10:
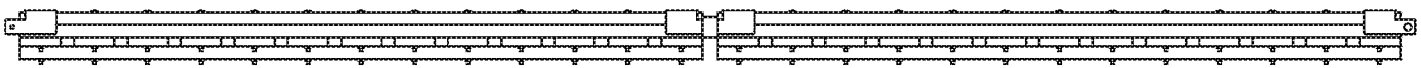
FIG. 10 is a side view of adjacent mats with a retainer clip locking the link in a flat position.
Figure 11:
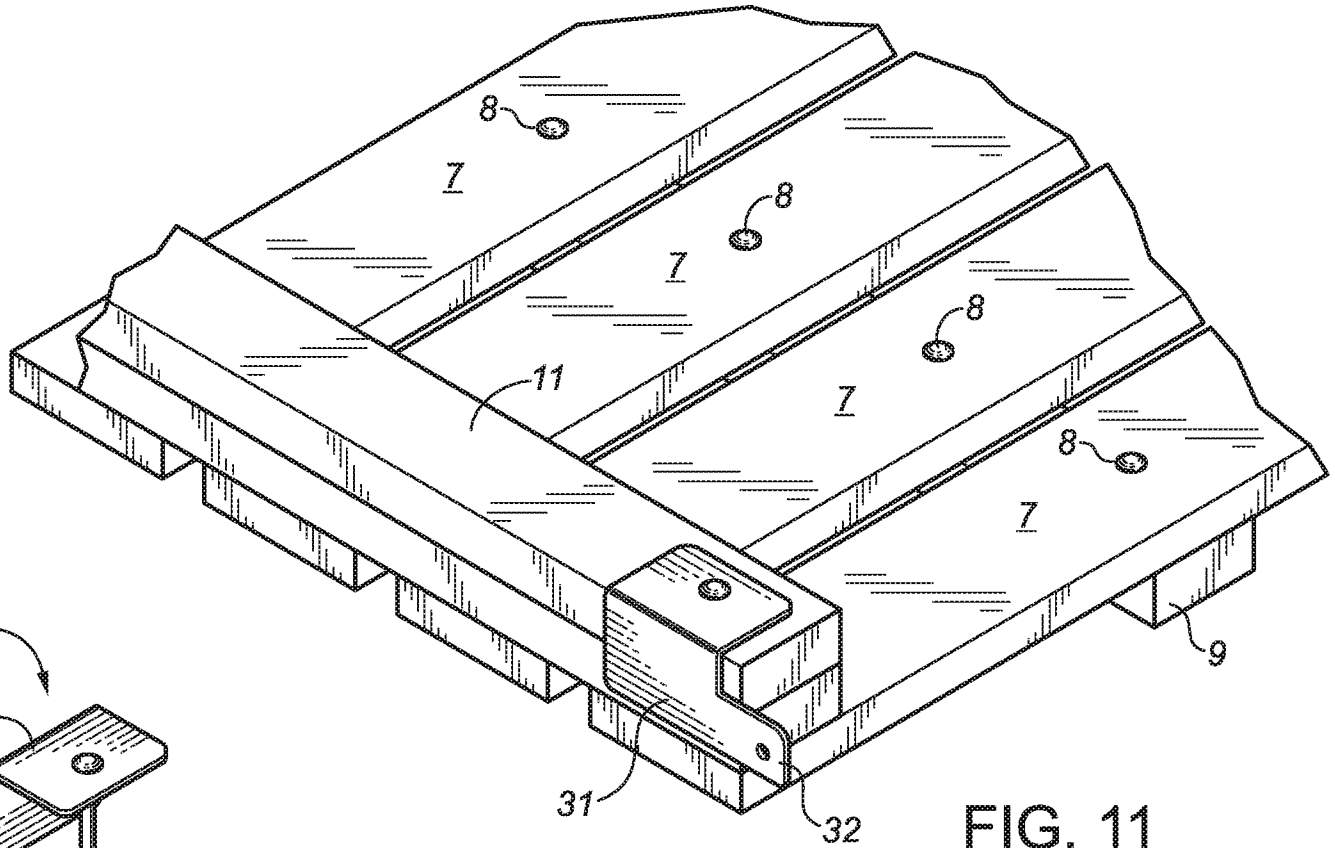
FIG. 11 is a perspective view showing a hinging link bracket mounted to the mat side rail.
Figure 12:
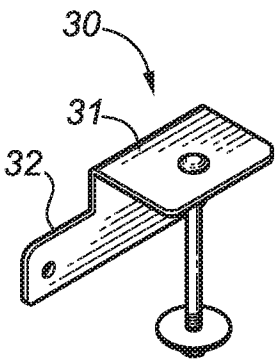
FIG. 12 is a perspective view of a hinging link bracket and bolt.
Figure 13:
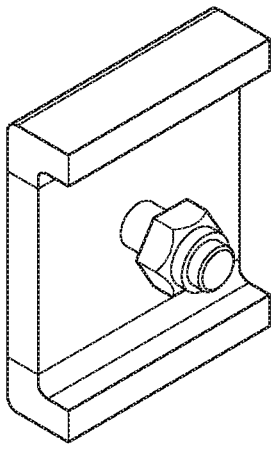
FIG. 13 is a perspective view of a retainer clip which may be used with a hinging link.

An alternative flexible link 30 is shown in FIGS. 11, 12. It comprises a bracket 31, bolted to the end of a side rail 11. The bracket 31 has a projecting lug 32. The lugs 32 of adjacent brackets are tied together by a pivot bolt 33 (see FIG. 8) which enables the adjacent mat ends to pivot relative to each other. A retainer clip 34 may be used to strengthen and lock the link 30 in one position.

The mats 4, 5 described are light enough to be carried by two men—for instance, the wooden rectangular mats 4 may weigh about 180 pounds.

It is contemplated that variants can be substituted for components of the mats just described. For example: cables can lash the ends of the mats together to provide the flexible links; and the boards, rails and straps can be formed of strong rigid plastic. Such variants are within the scope of the claims now following.

The invention claimed is:

1. A roadway for use by light vehicles on uneven ground comprising:

- a plurality of wooden mats flexibly linked together end-to-end by links so that adjacent mat ends can pivot relative to each other to allow the mats to follow the contours of underlying uneven ground;
- the mats having protrusions extending downwardly from their undersides for anchoring the mats to the ground;
- the mats having rails extending upwardly along their side edges to provide curbs;
- each mat being sufficiently compact and light so that it can be manually carried by two men for assembly in the field to form the roadway; and
- the links being mounted to the ends of the rails.

2. The roadway as set forth in claim 1, wherein:

- each mat comprises an assembly of wooden boards and has a length in the order of about eight feet and a width in the order of about 6 feet.

3. The roadway as set forth in claim 2, wherein some of the mats are rectangular in configuration, to form straight sections of the roadway, and some of the mats are trapezoidal in configuration, to form curved sections of the roadway.

4. The roadway as set forth in claim 1, wherein some of the mats are rectangular in configuration, to form straight sections of the roadway, and some of the mats are trapezoidal in configuration, to form curved sections of the roadway.

5. A roadway for use by light vehicles on uneven ground, comprising:

a plurality of wooden mats flexibly linked together end-to-end by links so that adjacent mat ends can pivot relative to each other to allow the mats to follow the contours of the ground;

each mat comprising:

a flat platform of transverse rectangular boards aligned in side-by-side formation;

rails secured to the platform to form a coherent unit therewith, said rails extending upwardly therefrom along the side edges thereof for providing curbs;

downwardly projecting, spaced apart straps extending longitudinally of the underside of the platform and secured to the platform;

links secured to the ends of the rails for flexibly linking one mat end to another in end-to-end alignment; and each mat being sufficiently compact and light so that it can be manually carried by two men.

* * * * *